United States Patent [19]

Medrano

[11] 4,358,864

[45] Nov. 16, 1982

[54] COMBINATION WASH BASIN AND TOILET CONSERVATION SYSTEM

[76] Inventor: Juan M. Medrano, Mexicali, Baja California, Mexico

[21] Appl. No.: 260,368

[22] Filed: May 4, 1981

[51] Int. Cl.[3] ..... A47K 4/00

[52] U.S. Cl. ..... 4/665; 4/364; 4/363; 4/415; 4/346

[58] Field of Search ..... 4/665, 661, 364, 363, 4/415, 317, 318, 345, 346

[56] References Cited

U.S. PATENT DOCUMENTS

| | | | |
|---|---|---|---|
| 1,935,779 | 11/1933 | Kemach | 4/665 |
| 2,860,348 | 11/1958 | McClenahan | 4/665 |
| 3,318,449 | 5/1967 | Jennings et al. | 4/665 |
| 3,588,922 | 6/1971 | Carfora | 4/665 |
| 3,696,448 | 10/1972 | Carfora | 4/665 |
| 4,030,144 | 6/1977 | Aleman | 4/665 |
| 4,089,073 | 5/1978 | Campbell | 4/665 |
| 4,206,520 | 6/1980 | Fulford | 4/665 |

*Primary Examiner*—Henry K. Artis

*Attorney, Agent, or Firm*—Charles C. Logan, II

[57] ABSTRACT

A combination wash basin and toilet water conservation system having at least one wash basin and a toilet having a water tank. The water tank has a fresh water chamber and a gray water chamber. A first outlet connects the gray water chamber with the bowl of the toilet and a flapper valve closes this outlet. A second outlet connects the fresh water chamber and the gray water chamber and a buoyant valve closes this outlet. Piping connects the drain of the wash basin to the gray water chamber. Piping also connects a source of fresh water to the fresh water chamber. A hand lever on the outside of the toilet operates a lever arm within the water tank which when it is raised upwardly actuates structure causing the buoyant valve to rise thereby letting fresh water into the gray water tank. Structure is also actuated in the gray water tank when the lever arm raises upwardly and this structure opens the flapper valve to release water from the gray water chamber into the toilet bowl for flushing thereof.

21 Claims, 12 Drawing Figures

COMBINATION WASH BASIN AND TOILET CONSERVATION SYSTEM

BACKGROUND OF THE INVENTION

The present invention relates to a wash basin and a toilet and more particularly to a combination system incorporating the two which conserves the use of fresh water by making use of water which has been used in the wash basin and has passed downwardly through its drain.

In the past toilets have been designed to use the dirty water exiting from the drain of a wash basin, but these have not proven entirely satisfactory. These previous systems have generally been very complicated in their manner of operation and also have had a low reliability in operation.

It is an object of the invention to provide a novel combination wash basin and toilet water conservation system that has a unique toilet water tank design.

It is also an object of the invention to provide a novel combination wash basin and toilet water conservation system that has a uniquely designed structure in the toilet water tank that operates the valves in the fresh water compartment and the gray water compartment.

It is another object of the invention to provide a novel combination wash basin and toilet water conservation system that is economical to manufacture and assemble.

It is an additional object of the invention to provide a novel combination wash basin and toilet water conservation system that operates with outstanding reliability.

SUMMARY OF THE INVENTION

The novel combination wash basin and toilet water conservation system performs the function of a conventional lavatory and toilet with substantially reduced requirements for quantity of water, installation space, and complexity of plumbing installation.

The quantity of fresh water required is reduced because gray (waste) water from the wash basin is used to supply all or a major portion of the water required for flushing the toilet. Provision is made to also use gray water from other wash basins and sinks for flushing the toilet, providing an additional saving of fresh water.

The wash basin and toilet can be installed as a single compact unit using the most appropriate of several configurations which are available, thus reducing the installation space requirement.

The plumbing installation for the novel combination wash basin and toilet water conservation system is simplified because one cold water, one hot water, and one sewer or waste water connection are required, compared to a conventional separate wash basin and separate toilet installation which requires two cold water, one hot water, and two sewer or waste water connections.

The first step in using the novel combination wash basin and toilet water conservation system starts with someone using the wash basin. The dirty water then passes from the drain of the wash basin into the back of the water tank of the toilet. In a similar fashion, waste water may be drained into the gray water chamber of the water tank from other wash basins which are not a part of but are connected to the combination wash basin and toilet water conservation system. Gray water flowing into the gray water chamber which is in excess requirements for flushing the toilet will pass through the overflow tube in the gray water chamber to the toilet bowl prior to flushing of the toilet.

If there is an insufficient level of water in the gray water chamber when the toilet handle is actuated, the lever arm which is connected to the toilet handle inside the water tank will be caused to rise upwardly thereby causing the buoyant valve in the fresh water chamber to open the outlet between the fresh water chamber and the gray water chamber. Since the level of the water in the fresh water chamber is always maintained higher than that of the water level in the gray water chamber, fresh water will flow into the gray water chamber until it has been brought up to a sufficient height which will allow the toilet to be flushed. There is cooperating structure within the gray water chamber that prevents actuation of the flapper valve (which allows flushing of the toilet) if there isn't a sufficient level of water in the gray water chamber. When the level of the water falls to a predetermined low level height, the cooperating structure in each the individual fresh water chamber and the gray water chamber, cause the actuating structure to reset itself and make the toilet ready for flushing again when a sufficient amount of gray water has been received into the gray water chamber of the water tank.

DESCRIPTION OF THE PREFERRED EMBODIMENT

Figure 1:
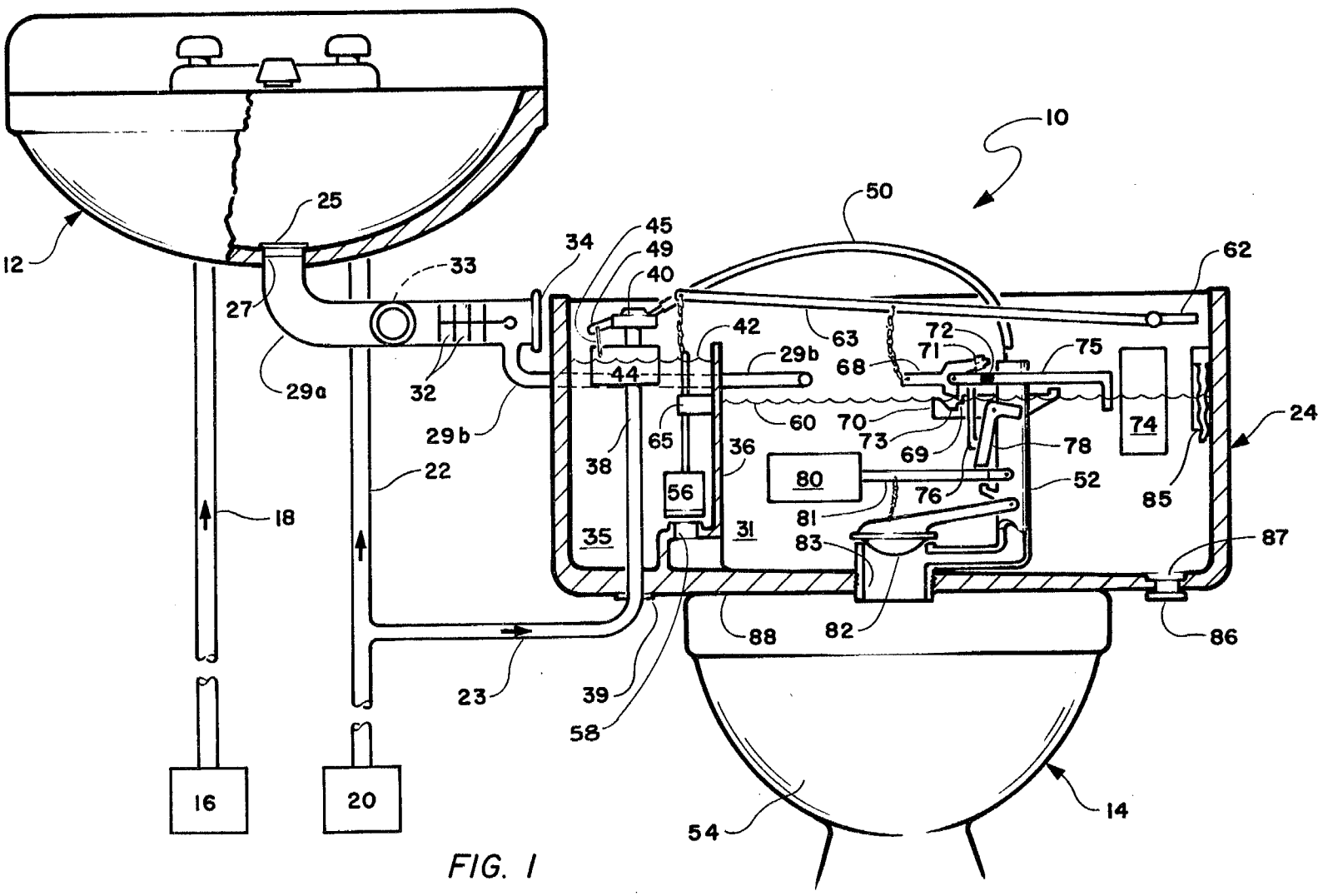
FIG. 1 is a front elevation view of the novel combination wash basin and toilet water conservation system with certain portions illustrated in cross-section.
Figure 5:
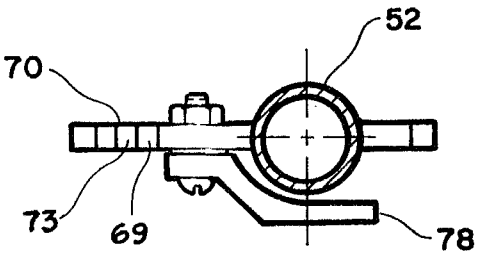
FIG. 5 is an isolated top plan view of the release latch of FIG. 1 and the structure upon which it is mounted.
Figure 4:
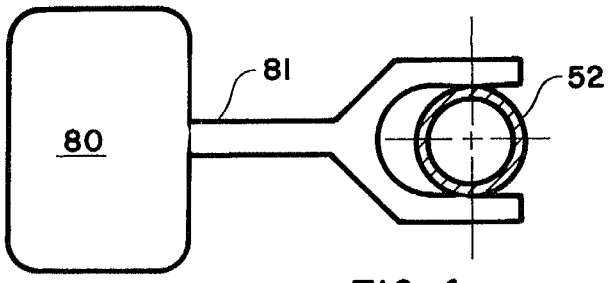
FIG. 4 is an isolated top plan view of the float within the gray water tank of FIG. 1.
Figure 3:
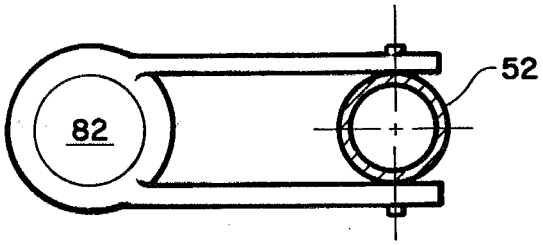
FIG. 3 is an isolated top plan view of the flapper valve of FIG. 1.
Figure 2:
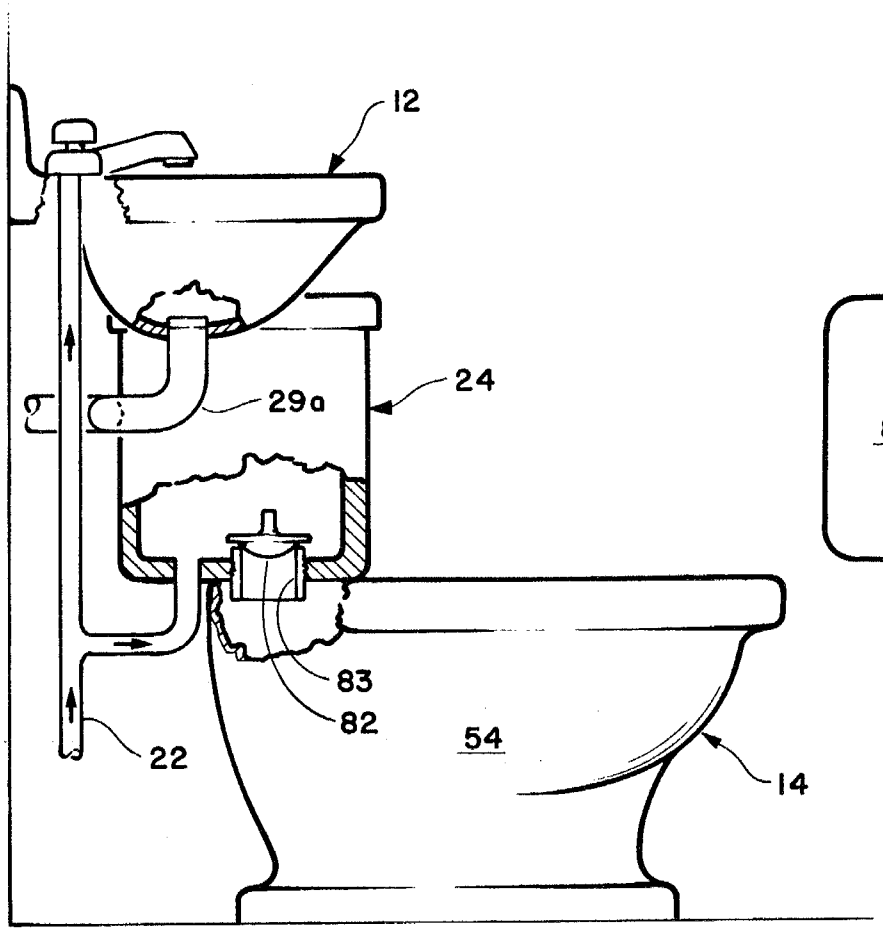
FIG. 2 is a side elevation view of the novel combination wash basin and toilet water conservation system with certain portions illustrated in cross-section.

Referring to FIGS. 1 and 2, the novel combination wash basin and toilet water conservation system that is generally designated numeral 10, will now be described.

The main components of the system are the wash basin 12 and the toilet 14. A hot water source 16 is connected by pipe 18 to wash basin 12. Cold water 20 is connected by pipe 22 to wash basin 12. Pipe 23 connects the cold water to the bottom of the water tank 24 of toilet 14.

When stopper 25 is removed from the drain 27 in the bottom of wash basin 12, the waste or dirty water passes through pipes 29 and 29*b* to the gray water chamber 31 of water tank 24. A plurality of filters 32 are positioned within pipe 29*a* and access to them can be had by removing screw cap 34 to periodically clean or replace the filters. Waste water or dirty water may also travel to gray water chamber 31 through connecting pipe 33 from other wash basins in the system.

A fresh water chamber 35 is also found within water tank 24. A wall 36 separates gray water chamber 31 and fresh water chamber 35. A fresh water inlet pipe 38 is connected to pipe 23 by coupling 39. A ballcock valve 40 is mounted on fresh water inlet pipe 38 and it operates to cutoff the flow of fresh water through that pipe when the proper fresh water level 42 has been reached. This closing of the ballcock valve 40 is produced by annular float 44 rising as the water of fresh water in the chamber 35 rises. A rod 45 has its lower end pivotally attached to annular float 44. The upper end of rod 45 is pinned to one end of lever arm 49 which actuates the ballcock valve 40 in response to the rising of float 44. An anti-siphon tube 50 has its free end positioned in overflow tube 52 and this prevents contamination of the fresh water source by preventing siphoning of water from fresh water chamber 35 into pipe 23 in the event of loss of pressure from the fresh water source 20. When ballcock valve 40 is open and furnishing water to fresh water chamber 35, a small amount of water will flow through anti-siphon tube 50 and through overflow tube 52 to rinse the toilet bowl 54.

When fresh water chamber 35 has been filled to its proper fresh water level 42, buoyant valve 56 will be held on to the valve seat at opening 58 by the static hydraulic pressure created at outlet 58 by the difference in height of fresh water level 42 and gray water level 60.

When it is desired to flush the toilet bowl 54, hand lever 62 is pressed causing lever arm 63 to raise buoyant valve 56. Buoyant valve 56 will be raised to stop 65 where it will remain due to its buoyance while water from fresh water chamber 35 flows into gray water chamber 31 through opening 58, causing float 56 to lower and open ballcock valve 40 which causes fresh water to flow through fresh water chamber 31 until the gray water level 60 has reached the same height as fresh water level 42.

When hand lever 62 is actuated, the raising of lever arm 63 also causes the unlatching of flush trigger 68 from notch 69 of arm 70. Trigger 68 will then be held in its unlatched position by magnets 71 and 72 permitting float 74 to raise actuating arm 75. This in turn causes a movement of lever 76 which will release latch 78 thus allowing float 80 to raise arm 81 which is pivotally attached to overflow tube 52. The raising of arm 81 causes flapper valve 82 to open allowing water to pass through outlet 83 to flush toilet bowl 54. Also, when latch 78 is released, float 74 will start to fall downwardly due to the lowering of the gray water level 60. This in turn causes actuating arm 75 to pivot clockwise and since trigger 68 has been captured previously in notch 73, magnet 71 will be drawn apart from magnet 72 and as this occurs trigger 68 will then be captured in notch 69, thus resetting the whole mechanism. When the gray water level 60 has lowered sufficiently, float 80 will lower to cause flapper valve 82 to close and latch 78 will reset.

When flapper valve 82 has closed, buoyant valve 56 will rest on the valve seat 58 and fresh water chamber 35 will be refilled to water level 42 by ballcock valve 40 and a small amount of water will flow through anti-siphon tube 50 and overflow tube 52 to rinse toilet bowl 54. Any gray water flowing into gray water chamber 31 from pipes 29*a* and 33 will be retained until the next flushing cycle.

A container 85 is mounted on one of the internal walls of water tank 24. It may be filled with a disinfectant, deodorant, and colored water.

A plug 86 is screw threaded into an aperture 87 in the bottom wall of water tank 24. It may be unscrewed periodically to remove sediment from the bottom of the tank. To encourage the sediment to collect near aperture 87 the bottom wall 88 slopes from left to right toward aperture 87.

Figure 7:
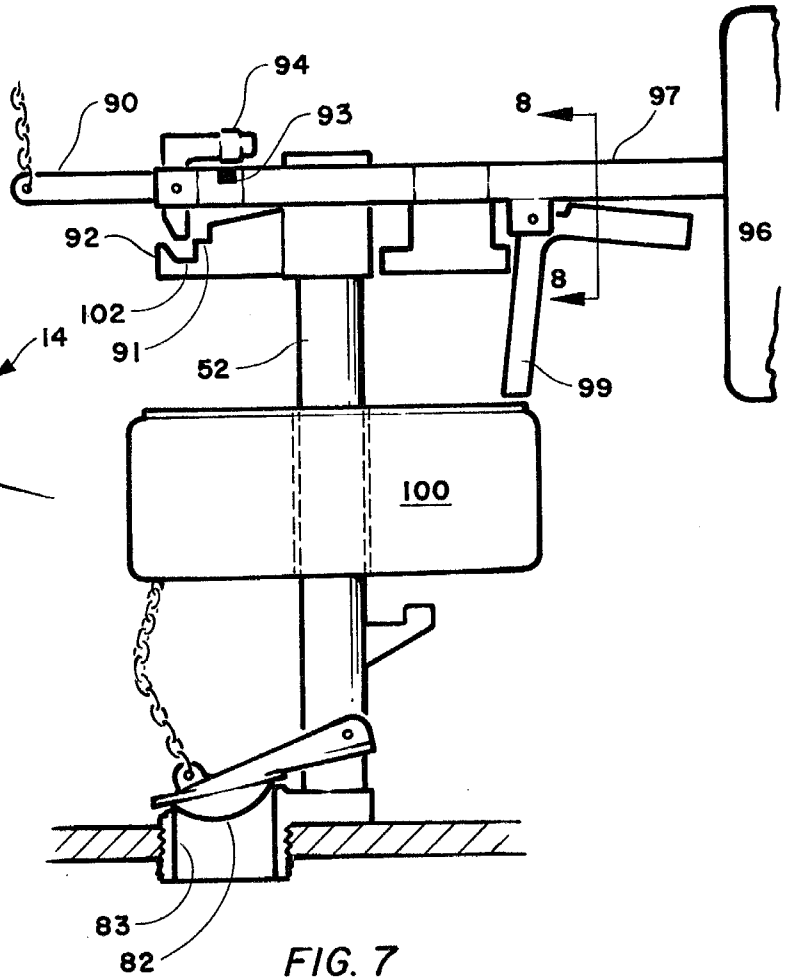
FIG. 7 is a front elevation view of a first alternative toilet flushing mechanism for the gray water tank.
Figure 8:
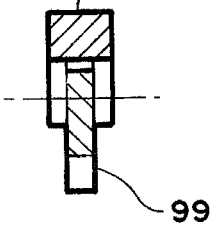
FIG. 8 is an elevational view taken along lines 8—8 of FIG. 7.
Figure 6:
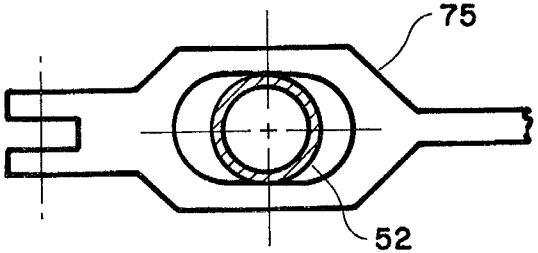
FIG. 6 is an isolated top plan view of the actuating arm of FIG. 1 in the gray water tank.

An alternative toilet flushing mechanism for the water chamber 31 is illustrated in FIGS. 7 and 8. The remaining structure that is illustrated in FIGS. 1 and 2 in water tank 24 is the same and functions in the manner as previously described.

When the hand lever 62 is actuated in the alternative toilet flushing mechanism, the raising of lever arm 63 also causes the unlatching of flush trigger 90 from notch 91 of arm 92. Flush trigger 90 will then be held in its unlatched position by magnets 93 and 94 permitting float 96 to raise actuating arm 97. This in turn causes a movement counter-clock-wise of release latch 99 thus allowing annular float 100 to raise flapper valve 82 which is pivotally attached to overflow tube 52. This allows water to pass through outlet 83 to flush toilet bowl 54.

Also, when release latch 99 is disengaged at its bottom extremity from float 100, float 96 will start to fall downwardly due to the lowering of the gray water level 60. This in turn causes actuating arm 97 to pivot clockwise and since flush trigger 90 has been captured previously in notch 102, magnet 94 will be drawn apart from magnet 93 and as this occurs flush trigger 90 will then be captured in notch 91, thus resetting the whole mechanism. When the gray water level 60 has lowered sufficiently, float 100 will lower to cause flapper valve 82 to close and release latch 99 will reset.

Figure 9:
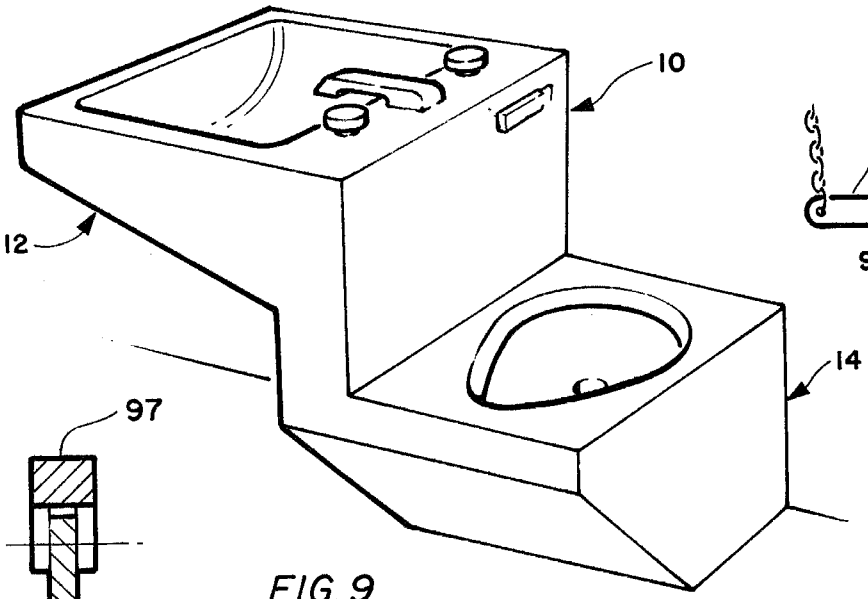
FIG. 9 is a perspective view of a first streamlined model of the novel combination wash basin and toilet conservation system.
Figures 10, 11, 12:
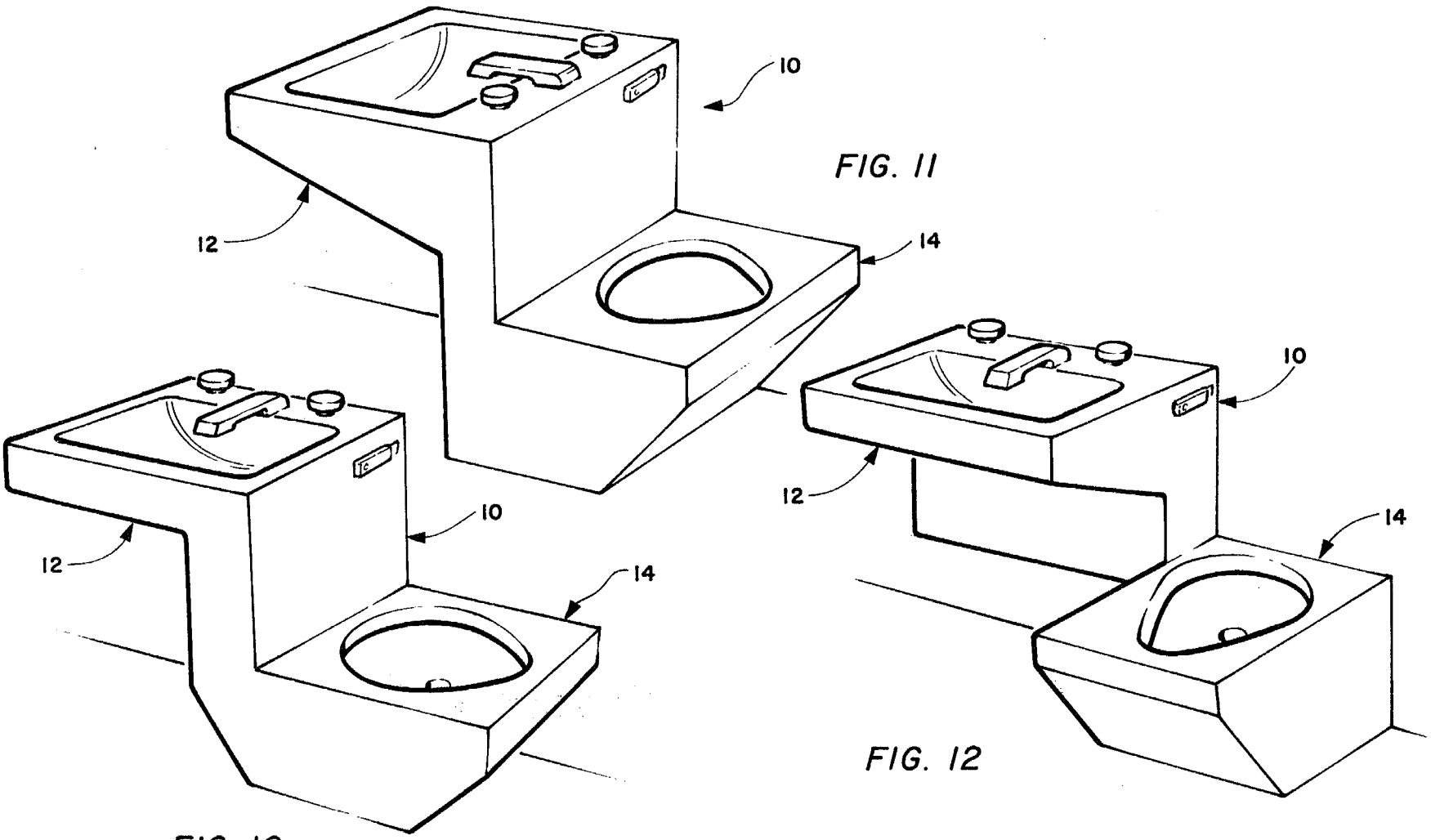
FIG. 10 is a perspective view of a second streamlined model of the novel combination wash basin and toilet conservation system.
FIG. 11 is a perspective view of a third streamlined model of the novel combination wash basin and toilet conservation system.
FIG. 12 is a perspective view of a fourth streamlined model of the novel combination wash basin and toilet conservation system.

The novel combination wash basin and toilet water conservation system that has been described previously may be housed in a streamlined unitary integral module. This streamlined module is illustrated in FIGS. 9–12. In FIGS. 9 and 10 the wash basin portion of the novel system is oriented 90 degrees away from the front of the toilet portion. The water tank in these two embodiments would either be located in the bottom of the wash basin portion or in the portion that structurally ties the wash basin portion to the toilet portion. The manner of operation of these embodiments would be identical to the previously described novel system.

In FIG. 11, the front of the wash basin portion is oriented 180 degrees away from the front of the toilet portion. In FIG. 12 the front of the wash basin and the front of the toilet portion are oriented in the same direction.

What is claimed is:

1. A combination wash basin and toilet water conservation system comprising:

at least one wash basin having a drain in its bottom;

a toilet having a water tank, said water tank having a fresh water chamber and a gray water chamber, a first outlet connecting said gray water chamber with the bowl of said toilet and a first valve member closing said first outlet, a second outlet connecting said fresh water chamber and said gray water chamber and a second valve member closing said second outlet;

means connecting the drain of said wash basin to said gray water chamber of said water tank;

a source of fresh water and means connecting said source of fresh water to said fresh water chamber of said water tank; and means for flushing said toilet.

2. A combination wash basin and toilet water conservation system as recited in claim 1 further comprising means for keeping the level of the water in the fresh water chamber higher than the level of the water in the gray water chamber.

3. A combination wash basin and toilet water conservation system as recited in claim 2 wherein said means for keeping the level of the water in the fresh water chamber higher than the level of the water in the gray water chamber comprises:

an overflow tube in said gray water chamber, said overflow tube being open at both its top and bottom ends, said bottom end being connected to said first outlet that connects said gray water chamber with the bowl of said toilet, said top end being located at a first predetermined height in said gray water chamber to control the maximum water level height in said gray water chamber.

4. A combination wash basin and toilet water conservation system as recited in claim 3 wherein said means for keeping the level of the water in the fresh water chamber higher than the level of the water in the gray water chamber further comprises:

a wall separating said fresh water chamber and said gray water chamber, the height of said wall being greater than the height of the top of said overflow tube.

5. A combination wash basin and toilet water conservation system as recited in claim 4 wherein said means for keeping the level of the water in the fresh water chamber higher than the level of the water in the gray water chamber further comprises: a fresh water inlet pipe located within said fresh water chamber and being connected to said means connecting said source of fresh water to said fresh water chamber, said fresh water inlet pipe having a third valve member located at its upper end for shutting off the flow of fresh water into said fresh water chamber.

6. A combination wash basin and toilet water conservation system as recited in claim 5 further comprising a first float member and connecting means between said third valve and said first float member for closing said third valve member when the level of said fresh water approaches the height of the wall separating said fresh water chamber and said gray water chamber.

7. A combination wash basin and toilet water conservation system as recited in claim 1 wherein said means for flushing said toilet comprises:

means for causing said first valve member to open; and means for causing said second valve member to open.

8. A combination wash basin and toilet water conservation system as recited in claim 7 wherein said first valve member is a flapper valve having laterally spaced arms that are pivotally connected about their one end to structure within said gray water chamber; and said means for causing said first valve member to open comprises a second float member attached to one end of an arm member whose other end is pivotally connected to structure within said gray water chamber; flexible connecting means are attached between said first valve and said float member whereby when said second float member is allowed to float upwardly, said first valve member will pivot to an open position.

9. A combination wash basin and toilet water conservation system as recited in claim 8 further comprising means for preventing said second float member from floating upwardly except when said toilet is flushed.

10. A combination wash basin and toilet water conservation system as recited in claim 9 wherein said means for preventing said second float member from floating upwardly comprises a release latch having a leg pivotally connected at its one end to structure within said gray water chamber while its opposite end bears against the top of the arm member which is connected at its free end to said second float member.

11. A combination wash basin and toilet water conservation system as recited in claim 10 further comprising means for actuating said release latch that allows said second float member to float upwardly thus allowing the toilet to be flushed.

12. A combination wash basin and toilet water conservation system as recited in claim 11 wherein said means for actuating said release latch comprises an actuating arm pivotally attached at its middle area to a vertically extending overflow tube in said gray water chamber, one end of said actuating arm has a third float member attached thereto and adjacent its other end a lever extends downwardly with a leg sticking outwardly that aligns with said downwardly extending leg of said release latch whereby when said third float member is free to rise a predetermined height, said lever will actuate said release latch which ultimately allows said toilet to be flushed.

13. A combination wash basin and toilet water conservation system as recited in claim 12 further comprising means for preventing said third float member from rising far enough to actuate said release latch, said means comprising an arm member extending laterally from said overflow tube, said arm member having first and second notches formed in its top surface to selectively receive a trigger that is pivotally mounted on the free end of said actuating arm, when said trigger mates with said first notch the flapper valve cannot be opened, when said trigger mates with said second notch, the flapper valve can be opened to flush the toilet.

14. A combination wash basin and toilet water conservation system as recited in claim 13 wherein said trigger has an arm extending outwardly from it to which is attached one end of a flexible member whose opposite end is attached to a lever arm that is raised in response to actuation of the toilet actuation control.

15. A combination wash basin and toilet water conservation system as recited in claim 7 wherein said means for causing said second valve member to open results from said second valve being a buoyant valve having a vertically oriented rod attached to it, said rod passing upwardly through a bore hole in a guide member attached to structure within said fresh water chamber, the bottom of said guide member also functions as a stop to limit the vertical travel of said buoyant valve, a flexible member connects the top of said rod to a lever arm that is caused to rise vertically by the actuation of the mechanism that is operated to flush the toilet.

16. A combination wash basin and toilet water conservation system as recited in claim 1 wherein said wash basin and said toilet are integrally formed as a single module.

17. A combination wash basin and toilet water conservation system as recited in claim 16 wherein the front of said wash basin portion is oriented 90 degrees away from the front of said toilet portion.

18. A combination wash basin and toilet water conservation system as recited in claim 17 wherein the front of said wash basin portion is also oriented with the front of said module.

19. A combination wash basin and toilet water conservation system as recited in claim 18 wherein the front of said toilet portion is also oriented with the front said module.

20. A combination wash basin and toilet water conservation system as recited in claim 16 wherein the front of said wash basin is oriented 180 degrees away from the front of said toilet portion.

21. A combination wash basin and toilet water conservation system as recited in claim 16 wherein the front of said wash basin portion and the front of said toilet portion are oriented in the same direction.

* * * * *